US009804542B2

(12) United States Patent
Hidaka

(10) Patent No.: US 9,804,542 B2
(45) Date of Patent: Oct. 31, 2017

(54) RECORDING MEDIUM TRANSPORT DEVICE, FIXING DEVICE, AND IMAGE FORMING APPARATUS

(71) Applicant: FUJI XEROX CO., LTD., Tokyo (JP)

(72) Inventor: Keisuke Hidaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/224,774

(22) Filed: Aug. 1, 2016

(65) Prior Publication Data

US 2017/0205738 A1 Jul. 20, 2017

(30) Foreign Application Priority Data

Jan. 14, 2016 (JP) ..... 2016-005495

(51) Int. Cl.
*G03G 15/20* (2006.01)

(52) U.S. Cl.
CPC ..... *G03G 15/2028* (2013.01); *G03G 15/2085* (2013.01)

(58) Field of Classification Search
CPC ..... G03G 15/2028; G03G 15/2085; G03G 15/6532; B65H 29/56
USPC ..... 399/323, 398, 399, 45
See application file for complete search history.

(56) References Cited

U.S. PATENT DOCUMENTS 6,782,229 B2 * 8/2004 Kurisu ..... G03G 15/2028 399/232 X
8,805,258 B2 * 8/2014 Chiba ..... G03G 15/2028 399/323
2011/0026986 A1 * 2/2011 Yamanaka ..... G03G 15/2028 399/323
2011/0222874 A1 * 9/2011 Yamada ..... G03G 15/2085 399/323 X
2011/0229201 A1 * 9/2011 Yamada ..... G03G 15/2028 399/323 X
2013/0202331 A1 * 8/2013 Maruko ..... G03G 15/2085 399/323

FOREIGN PATENT DOCUMENTS

JP 2008-132503 A 6/2008
JP 2012-123389 A 6/2012

* cited by examiner

*Primary Examiner* — Sophia S Chen
(74) *Attorney, Agent, or Firm* — Sughrue Mion, PLLC

(57) ABSTRACT

A recording medium transport device includes a first rotating member, a second rotating member, a first shaft, a second shaft, a contact member, a pressure member, and a transmission part. The second rotating member is configured to form, together with the first rotating member, a nip, and nips a recording medium in the nip so as to transport the recording medium. The contact member is spaced from the first rotating member and brought into contact with the recording medium. The contact member is movable about an axis of the first shaft in an arc-shaped path. The pressure member is movable about an axis of the second shaft in an arc-shaped path and presses the second rotating member toward the first rotating member. The transmission part is brought into contact with the pressure member so as to transmit a movement of the pressure member to the contact member.

7 Claims, 10 Drawing Sheets

RECORDING MEDIUM TRANSPORT DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2016-005495 filed Jan. 14, 2016.

BACKGROUND

Technical Field

The present invention relates to a recording medium transport device, a fixing device, and an image forming apparatus.

SUMMARY

According to an aspect of the present invention, a recording medium transport device includes a first rotating member, a second rotating member, a first shaft, a second shaft, a contact member, a pressure member, and a transmission part. The second rotating member is configured to form, together with the first rotating member, a nip, and nips a recording medium in the nip so as to transport the recording medium. The first shaft extends in an axial direction of the first rotating member. The second shaft has a center position and extends in an axial direction of the second rotating member. The contact member is disposed at a position downstream of the nip in a transport direction of the recording medium so as to be spaced from the first rotating member and so as to be, at the position where the contact member is disposed, brought into contact with the recording medium being transported. The contact member is movable about an axis of the first shaft in an arc-shaped path at a region radially outside the first rotating member. The pressure member is movable about an axis of the second shaft in an arc-shaped path and presses the second rotating member toward the first rotating member. The transmission part is provided in the contact member or formed in the contact member and brought into contact with the pressure member so as to transmit a movement of the pressure member to the contact member. The transmission part has a surface in contact with the pressure member at a position on an opposite side to a second shaft side of the pressure member and has an arc shape centered at the center position of the second shaft.

BRIEF DESCRIPTION OF THE DRAWINGS

Exemplary embodiment of the present invention will be described in detail based on the following figures, wherein.

DETAILED DESCRIPTION

Examples of a recording medium transport device, a fixing device, and an image forming apparatus according to an exemplary embodiment are described.

An Overall Structure

Figure 1:
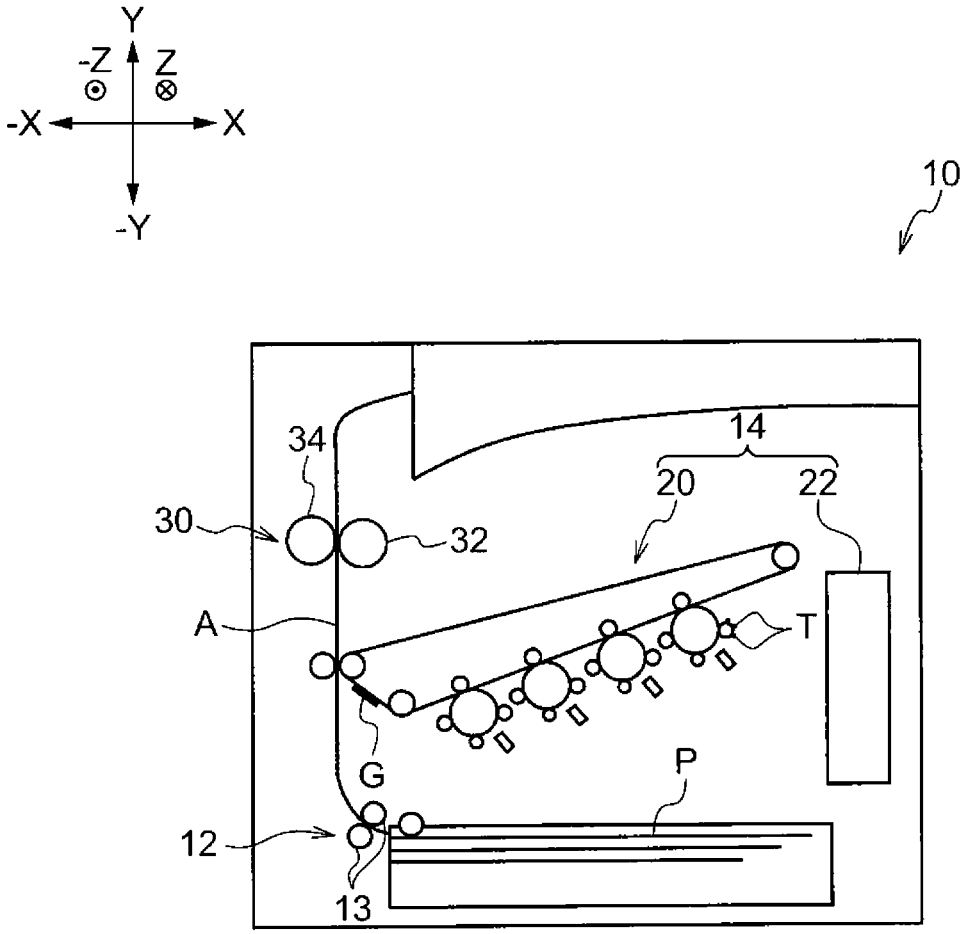
FIG. 1 is a structural view of an image forming apparatus according to an exemplary embodiment.

FIG. 1 illustrates an image forming apparatus 10 according to the present exemplary embodiment. The image forming apparatus 10 includes, for example, a transport unit 12, an image forming section 14, and a fixing section 30. The transport unit 12 includes a roller pair 13 that transports a sheet P. The image forming section 14 forms a toner image G with toner T on the sheet P transported by the transport unit 12. The fixing section 30 heats the toner image G so as to fix the toner image G onto the sheet P. The sheet P is an example of a recording medium. The toner T is an example of developer. The toner image G is an example of a developer image. The image forming section 14 is an example of a developer image forming device. The fixing section 30 is an example of a recording medium transport device.

In the following description, a direction indicated by a double-headed arrow Y of FIG. 1 is an apparatus height direction and a direction indicated by a double-headed arrow X of FIG. 1 is an apparatus width direction. Furthermore, a direction (indicated by "Z") perpendicular to the apparatus height direction and the apparatus width direction is an apparatus depth direction. When the image forming apparatus 10 is seen from the front, the apparatus height direction, the apparatus width direction, and the apparatus depth direction are respectively referred to as the Y direction, the X direction, and the Z direction. Furthermore, in the case where it is necessary to distinguish one side and another side from each other in each of the X direction, the Y direction, and the Z direction, when the image forming apparatus 10 is seen from the front, the upper side is referred to as the Y side, the lower side is referred to as the −Y side, the right side is referred to as the X side, the left side is referred to as the −X side, the rear side is referred to as the Z side, and the front side is referred to as the −Z side.

The image forming section 14 includes an image forming unit 20 and a controller 22. The controller 22 controls operations of parts of the image forming unit 20 so as to form the toner image G on the sheet P. The image forming unit 20 performs, for example, charging, exposing, developing, and transferring processes which are performed by a known electrophotographic system.

Structures of Components

Next, the fixing section 30 is described.

Figure 2:
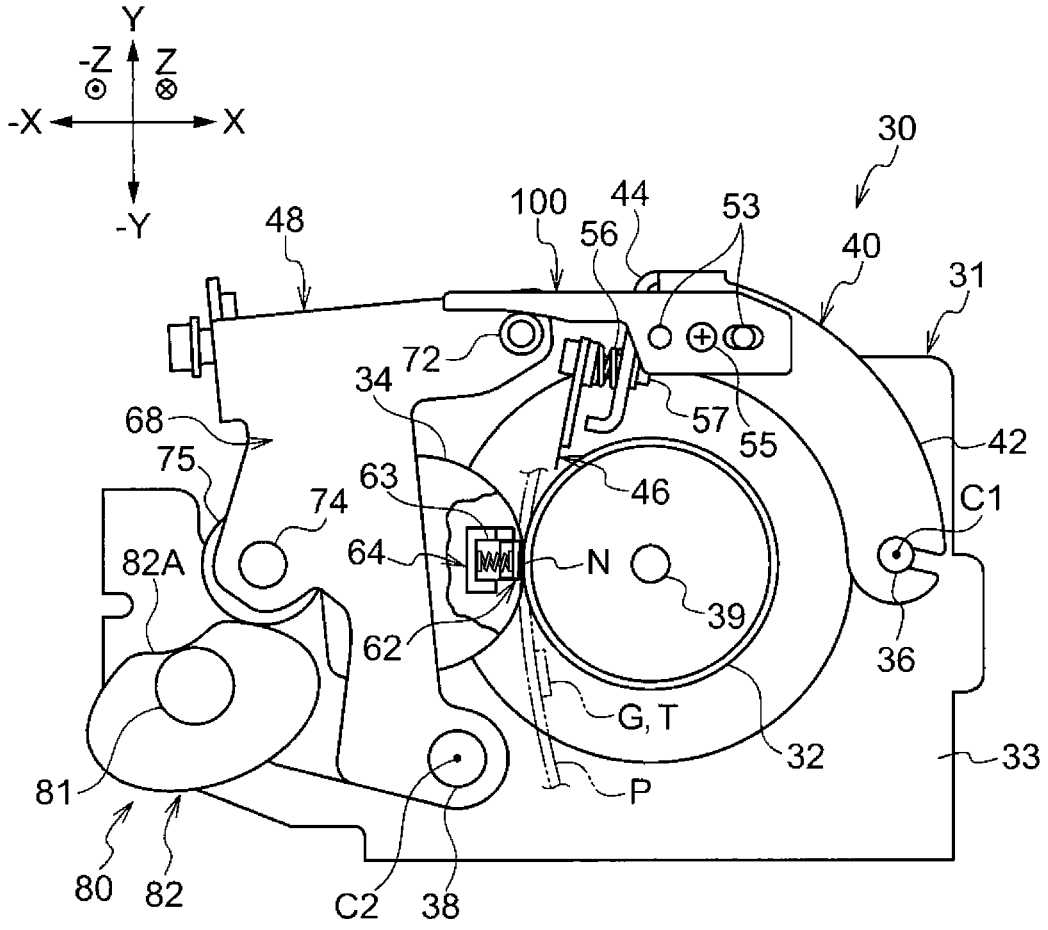
FIG. 2 illustrates a fixing section according to the present exemplary embodiment when seen in the axial direction of a fixing roller.

The fixing section 30 of FIG. 2 includes a housing 31 that serves as a section body, a fixing roller 32, a pressure belt 34, a separation member 40, a pressure member 48, and a cam member 100. The fixing roller 32 is an example of a first rotating member and a fixing rotating member. The pressure belt 34 is an example of a second rotating member. The separation member 40 is an example of a contact member. The cam member 100 is an example of a transmission part.

The Housing

The housing 31 has a box shape, and the longitudinal direction thereof is in the Z direction. Walls (not illustrated) are provided on the Y side and the −Y side of the housing 31 and have respective openings that allow the sheet P to pass therethrough. Furthermore, the housing 31 includes a pair of side walls 33. The pair of side walls 33 face each other in the Z direction. The pair of side walls 33 are disposed along respective X-Y planes. Cylindrical shafts 36 the axial direction of which is in the Z direction are provided on the X side of the pair of side walls 33. Also, cylindrical shafts 38 the axial direction of which is in the Z direction are provided on the −X side of the pair of side walls 33.

The shafts 36 are an example of a first shaft and project to the Z side and −Z side between the pair of side walls 33. Specifically, the shafts 36 extend in the axial direction (Z direction) of the fixing roller 32 radially outside the fixing roller 32 (further to the X side than the fixing roller 32). An axis C1 of one of the shafts 36 is represented as a point C1 of FIG. 2.

The shafts 38 are an example of a second shaft and project to the Z side and −Z side on inner sides of the pair of side walls 33. Specifically, the shafts 38 extend in the axial direction (Z direction) of the pressure belt 34 radially outside the pressure belt 34 (further to the −X side than the pressure belt 34). An axis C2 of the shafts 38 is represented as a point C2 of FIG. 2.

The Fixing Roller

The fixing roller 32 includes, for example, a cylindrical core formed of aluminum, an elastic layer formed of silicon rubber, and a mold release layer formed of a fluoroplastic. The elastic layer and the mold release layer are formed on an outer circumferential surface of the core. The fixing roller 32 is rotatable about its axis extending in the Z direction. The fixing roller 32 is disposed on the toner image G side (X side) of a transport path A (see FIG. 1) of the sheet P. A halogen heater 39 serving as an example of a heat source is provided on an inner circumferential side of the core of the fixing roller 32.

Power is supplied from a power source (not illustrated) to the halogen heater 39 so that the halogen heater 39 generates heat. The heat generated by the halogen heater 39 heats the core, thereby the entire fixing roller 32 is heated. Furthermore, a gear (not illustrated) is provided on the Z side of a shaft of the fixing roller 32. This gear is rotated by a motor (not illustrated). Thus, the fixing roller 32 heated by the halogen heater 39 fixes the toner image G (toner T) on the sheet P onto the sheet P while being rotated.

The Pressure Belt

The pressure belt 34 is rotatable (movable in a circular path) about its axis extending in the Z direction. The pressure belt 34 is disposed on the opposite side to (−X side of) the fixing roller 32 side of the transport path A (see FIG. 1) of the sheet P. The pressure belt 34 is structured as an endless belt and includes a base layer and a mold release layer coated on an outer circumferential surface of the base layer. The base layer is formed of a polymer such as polyimide, polyamide, or polyimidoamide or a metal such as stainless steel, nickel, or copper. The mold release layer is formed of, for example, a fluoroplastic.

Furthermore, a pressure pad 62, which will be described later, is provided on an inner circumferential side of the pressure belt 34. The pressure belt 34 is moved in a circular path in synchronization with the rotation of the fixing roller 32 due to a frictional force generated between the pressure belt 34 and the fixing roller 32. The pressure belt 34 together with the fixing roller 32 nips and transports the sheet P. A portion where an outer circumferential surface of the fixing roller 32 and an outer circumferential surface of the pressure belt 34 nip and press the sheet P is referred to as a nip N. That is, the pressure belt 34 and the fixing roller 32 form the nip N. When there is no sheet P in the nip N, the fixing roller 32 and the pressure belt 34 are in contact with each other in the nip N. According to the present exemplary embodiment, in the fixing section 30, for example, a transport direction of the sheet P is in the Y direction, and a width direction perpendicular to the transport direction of the sheet P is in the Z direction.

The Separation Member

The separation member 40 includes a pair of brackets 42, an attachment 44, and a separation baffle 46. The brackets 42 face each other in the Z direction. Both end portions of the attachment 44 in the Z direction are supported by the pair of brackets 42. The separation baffle 46 is attached to the attachment 44. The structure of one of the brackets 42 on the Z side and another bracket 42 on the −Z side are the same as or similar to each other. Furthermore, the one and the other brackets 42 are arranged symmetrically about the center of the fixing roller 32 in the Z direction. Thus, the bracket 42 on the −Z side is described and description of the bracket 42 on the Z side is omitted.

The Bracket

The bracket 42 is disposed along the X-Y plane and has an arc shape when seen in the Z direction. Specifically, the bracket 42 has a quarter circle shape formed by dividing an annular plate into four parts in a circumferential direction. Furthermore, one end portion (end portion on the −Y side) of the bracket 42 in the circumferential direction is rotatably connected to one of the shafts 36. That is, in a region radially outside the fixing roller 32, the bracket 42 is movable about the axis C1 in an arc-shaped path centered at the shaft 36 (axis C1). Two bosses 53 projecting outward (to the −Z side) and an internal screw portion (not illustrated) into which a screw 55 is screwed are formed in a side surface of the bracket 42 on the −Z side at another end portion of the bracket 42 in the circumferential direction. The internal screw portion is disposed between two bosses 53.

The Attachment

The attachment 44 is, for example, a member the longitudinal direction of which is in the Z direction. Each of the end portions of the attachment 44 in the Z direction is secured to the other end portion of a corresponding one of the pair of brackets 42 in the circumferential direction when seen in the Z direction. Furthermore, part of the attachment 44 is inclined such that, when seen in the Z direction, an end portion of the part of the attachment 44 on the Y side in the Y direction is disposed further to the X side than another end portion of the part of the attachment 44 on the −Y side in the Y direction. In addition, the end portion of the attachment 44 on the −Y side is bent to the −X side.

The attachment 44 has internal screw portions (not illustrated) spaced from one another in the Z direction. Screws 57 are screwed into these internal screw portions. The screws 57 secure a proximal end portion 46A (see FIG. 5) of the separation baffle 46, which will be described later, to the attachment 44. Also, the screws 57 are inserted through compression coil springs 56. That is, when external screw portions of the screws 57 are screwed into the internal screw portions of the attachment 44, the compression coil springs 56 press the proximal end portion 46A of the separation baffle 46 to a side separating from the attachment 44.

The Separation Baffle

Figure 5:
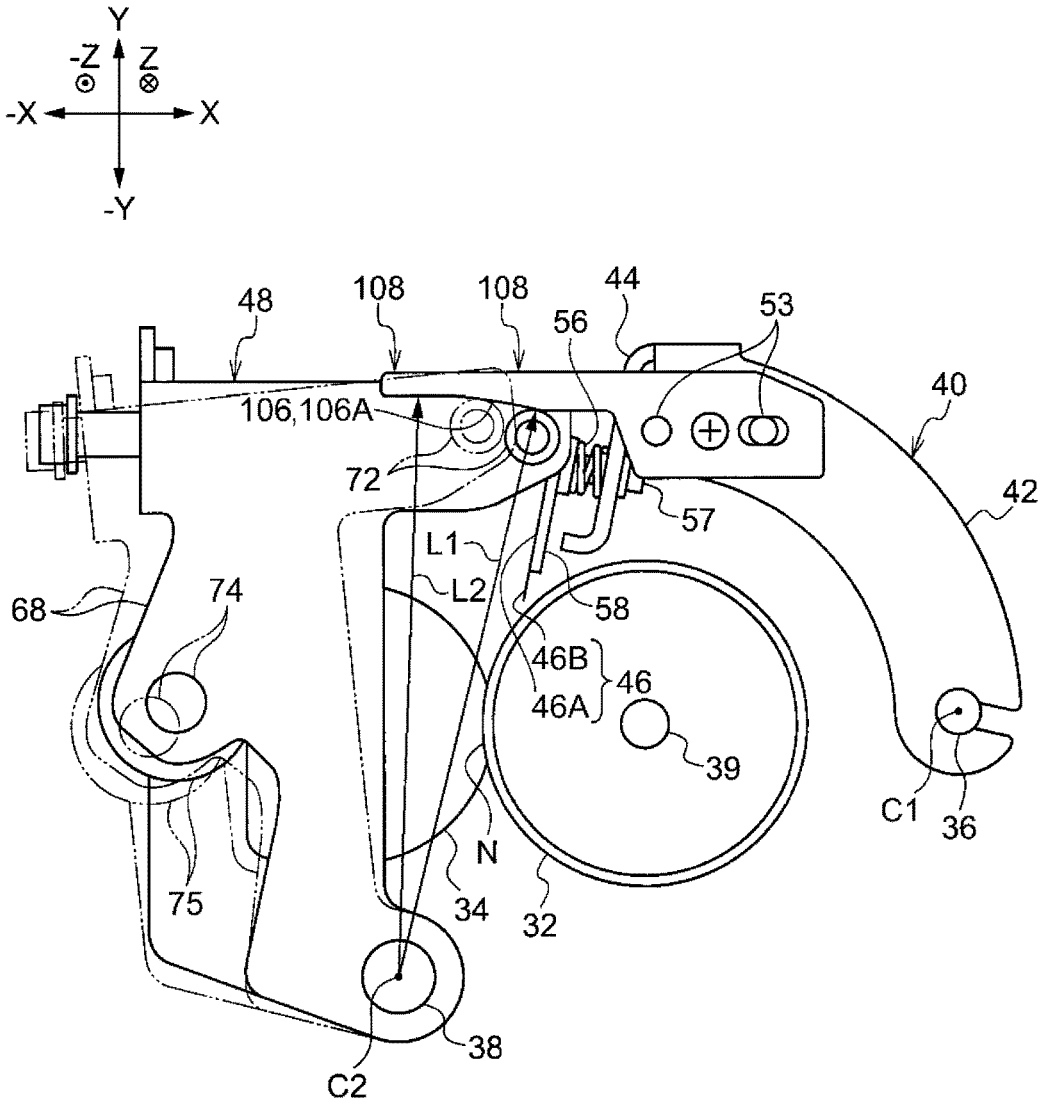
FIG. 5 illustrates a contact state between a cam follower and the cam member when the first lever and the second lever according to the present exemplary embodiment are moved.

The separation baffle 46 of FIG. 5 is, for example, a rectangular plate the longitudinal direction of which is in the Z direction. The separation baffle 46 includes the proximal end portion 46A and a distal end portion 46B. The proximal end portion 46A is secured to (held by), for example, a rectangular plate-shaped holder 58 by bonding. The longitudinal direction of the holder 58 is in the Z direction. The holder 58 is attached to the −X side of the attachment 44 by the screws 57 and pressed to the −X side by the compression coil springs 56. Thus, the proximal end portion 46A of the separation baffle 46 is attached to the bracket 42 with the holder 58 interposed therebetween.

Figure 7:
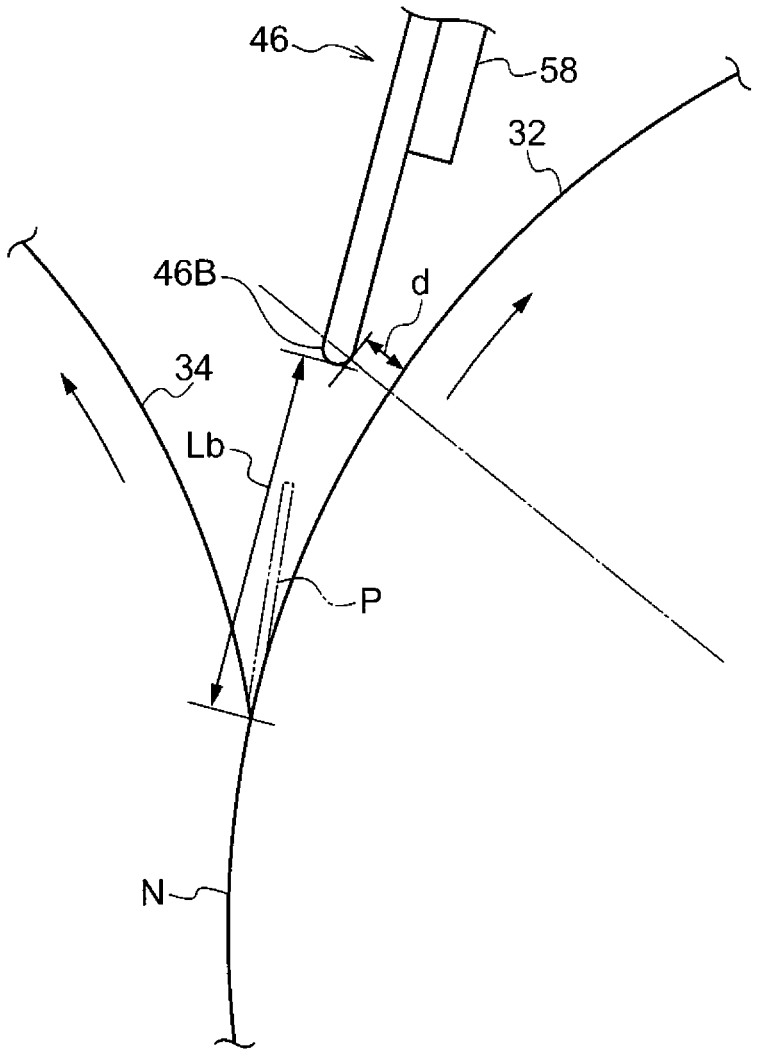
FIG. 7 schematically illustrates disposition of a separation baffle according to the present exemplary embodiment.

As illustrated in FIG. 7, the distal end portion 46B of the separation baffle 46 is a free end portion that projects from the holder 58. Furthermore, the distal end portion 46B is disposed at a position downstream of the nip N in the transport direction of the sheet P so as to be brought into contact with the sheet P being transported with a gap d formed between the distal end portion 46B and the outer circumferential surface of the fixing roller 32. The distal end portion 46B is oriented such that a projecting direction thereof from the holder 58 is opposite to a rotational direction of the fixing roller 32. A distance Lb is the distance from a downstream end of the nip N and the distal end portion 46B in the transport direction of the sheet P. Here, the distal end portion 46B of the separation baffle 46 is brought into contact with a leading end in the transport direction of the sheet P having been transported, thereby the separation baffle 46 guides (separates) the sheet P in a direction separating from the outer circumferential surface of the fixing roller 32.

The Pressure Member

The pressure member 48 of FIG. 2 includes the pressure pad 62, a holder 64, first levers 66 (see FIG. 3), and second levers 68. The holder 64 holds the pressure pad 62. The holder 64 is supported by the first levers 66. The first levers 66 are movably provided in the second levers 68. Furthermore, the pressure member 48 is able to be moved by a cam unit 80 about the axis C2 in an arc-shaped path when seen in the Z direction.

The Pressure Pad

Figure 6A:
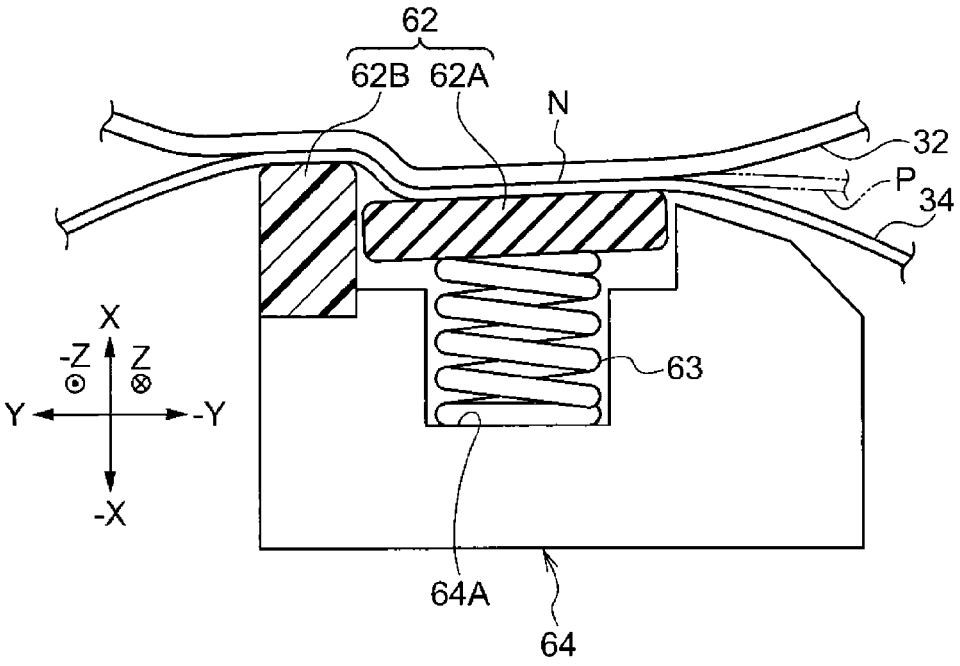
FIG. 6A illustrates the fixing roller and a pressure belt when a pressing state of a nip according to the present exemplary embodiment is in a full-latch state.

As illustrated in FIG. 6A, the pressure pad 62 is disposed on the inner circumferential side of the pressure belt 34. The pressure pad 62 includes, for example, a pad member 62A and a pad member 62B. In FIG. 2, the pressure pad 62, the holder 64, and a compression coil spring 63, which will be described later, are drawn in a reduced scale.

The pad member 62A of FIG. 6A includes, for example, rectangular plate-shaped silicon rubber the longitudinal direction of which is in the Z direction and the transverse direction of which is in the transport direction of the sheet P. Furthermore, the pad member 62A is in contact with the pressure belt 34 in a region from an upstream end portion to a central portion of the nip N in the transport direction of the sheet P, thereby pressing the pressure belt 34 using a pushing force of the compression coil spring 63, which will be described later.

The pad member 62B is, for example, formed of silicon resin and has a rectangular parallelopiped shape elongated in the Z direction. Furthermore, the pad member 62B is secured to the holder 64, which will be described later, and in contact with the pressure belt 34 at a downstream end portion of the nip N in the transport direction of the sheet P, thereby pressing the pressure belt 34.

The Holder

The holder 64 is, for example, an elongated member elongated in the Z direction and disposed on the inner circumferential side of the pressure belt 34. The holder 64 has a recess 64A extending to the −X side when the holder 64 is seen in the Z direction. The compression coil spring 63 deformable in the X direction is provided in the recess 64A. The compression coil spring 63 presses the pad member 62A against the pressure belt 34. Furthermore, an end portion of the pad member 62B on the −X side is secured to an end portion of the holder 64 on the Y side by a screw (not illustrated). In addition, both end portions of the holder 64 in the Z direction are secured to the first levers 66 (see FIG. 3) by screws (not illustrated).

Figure 6B:
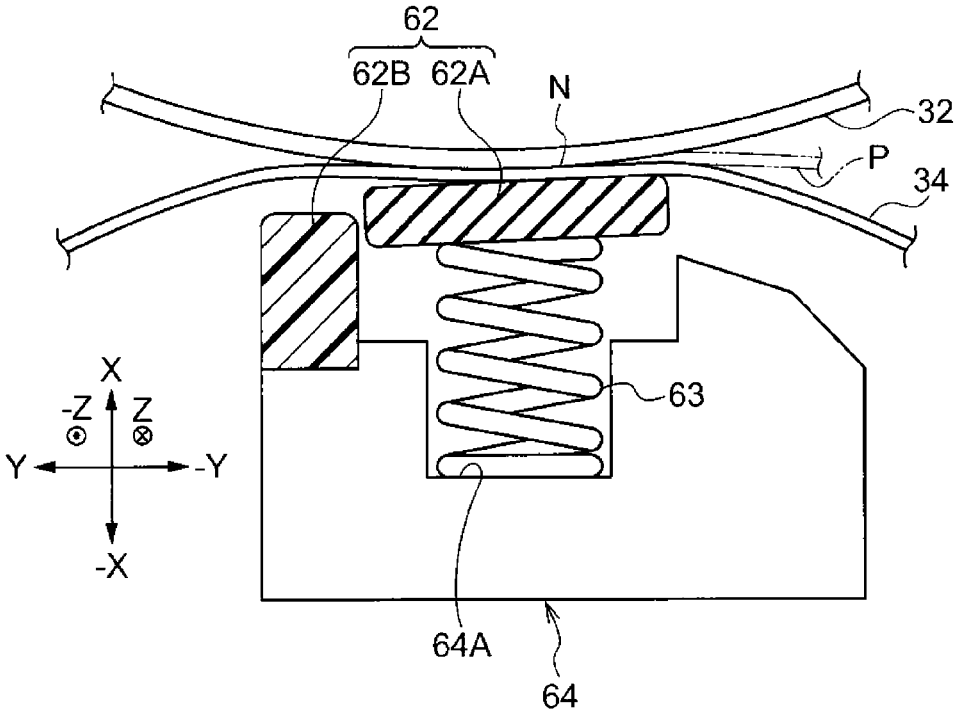
FIG. 6B illustrates the fixing roller and the pressure belt when the pressing state of the nip according to the present exemplary embodiment is in a half-latch state.
Figure 8:
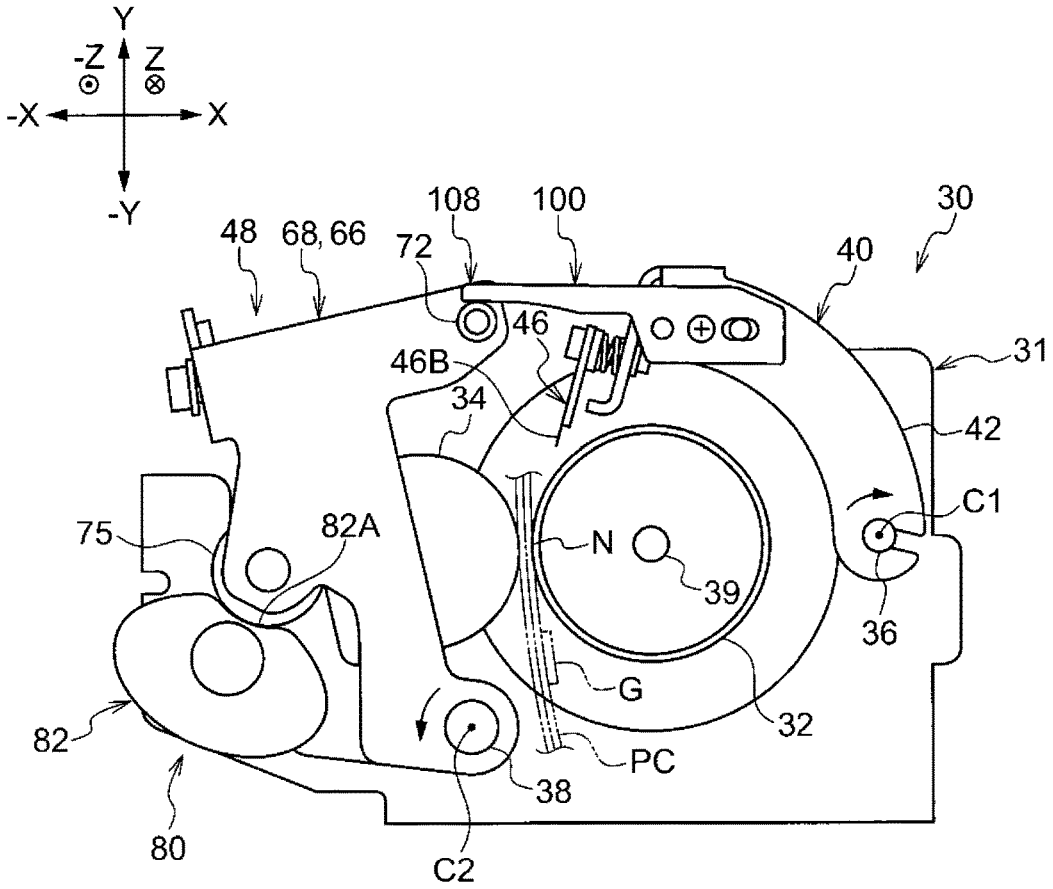
FIG. 8 illustrates disposition of the cam member and the second lever when the pressing state of the nip is in a latch release state in the fixing section according to the present exemplary embodiment.

Here, a pressing state in which the pad member 62A is pressed farther to the holder 64 side than the pad member 62B (a state in which the pad member 62A and the pad member 62B are in contact with the pressure belt 34) as illustrated in FIG. 6A is referred to as a full-latch state. Furthermore, a pressing state in which the pad member 62A is in contact with the pressure belt 34 and the pad member 62B is not in contact with the pressure belt 34 as illustrated in FIG. 6B is referred to as a half-latch state. That is, when the fixing roller 32 and the pressure belt 34 are in contact with each other or when the sheet P is nipped between the fixing roller 32 and the pressure belt 34, a pressing force of the pressure belt 34 is high in the full-latch state and the pressing force of the pressure belt 34 in the half-latch state is lower than that in the full-latch state. Furthermore, a state as illustrated in FIG. 8 in which the pressing force of the pressure belt 34 is lower than that in the half-latch state is referred to as a latch release state.

Figure 3:
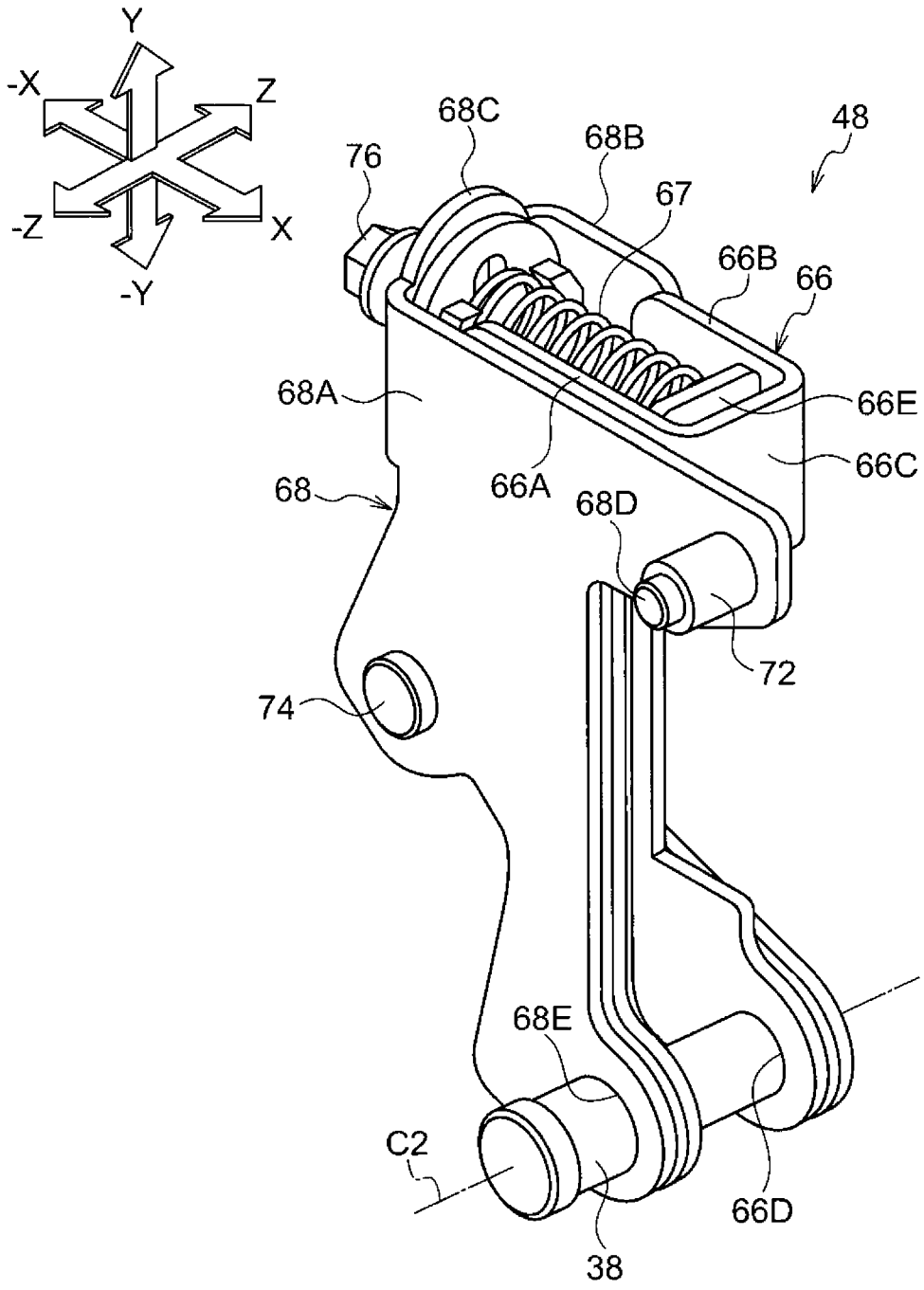
FIG. 3 is a perspective view of a first lever and a second lever according to the present exemplary embodiment.

FIG. 3 illustrates one of the first levers 66 and a corresponding one of the second levers 68 disposed on the −Z side. The structures of the first levers 66 on the Z side and on the −Z side are the same as or similar to each other, and the structures of the second levers 68 on the Z side and on the −Z side are the same as or similar to each other. Furthermore, the first levers 66 on the Z side and on the −Z side are arranged symmetrically about the center of the holder 64 (see FIG. 2) in the Z direction, and the second levers 68 on the Z side and on the −Z side are arranged symmetrically about the center of the holder 64 in the Z direction. Thus, the first lever 66 and the second lever 68 on the −Z side are described and description of the first lever 66 and the second lever 68 on the Z side is omitted. The first levers 66 have respective U-shaped recess portions to which the respective end portions of the holder 64 in the Z direction are secured by screws (not illustrated).

The First Lever

The first lever 66 includes an outer wall 66A, an inner wall 66B, and a front wall 66C. The outer wall 66A and the inner wall 66B are spaced from each other in the Z direction. The outer wall 66A is disposed further to the −Z side than the inner wall 66B. The outer wall 66A and the inner wall 66B have U shapes that open on the X side when seen in the Z direction. The front wall 66C connects an end portion of the outer wall 66A on the Y side on the X side of the outer wall 66A to an end portion of the inner wall 66B on the Y side on the X side of the outer wall 66A. Furthermore, an end portion of the outer wall 66A on the −Y side and an end portion of the inner wall 66B on the −Y side have respective through holes 66D penetrating through the outer wall 66A and and the inner wall 66B in the Z direction. The first lever 66 is provided on one of the above-described shafts 38 so as to be movable about the axis C2 in an arc-shaped path by inserting the shaft 38 through the through holes 66D.

A plate-shaped pressed portion 66E is formed in a portion of the first lever 66 disposed further to the −X side than the front wall 66C. The pressed portion 66E has an internal screw portion (not illustrated) that penetrates through the pressed portion 66E in the X direction. Furthermore, an end portion of a compression coil spring 67 on the X side is in contact with a surface of the pressed portion 66E on the −X side. An end portion of the compression coil spring 67 on the −X side is in contact with the second lever 68, which will be described later. That is, the end portion of the first lever 66 on the Y side is pressed to a side separating from the second lever 68 by a pushing force of the compression coil spring 67.

The Second Lever

The second lever 68 includes an outer wall 68A, an inner wall 68B, and a rear wall 68C. The outer wall 68A and the inner wall 68B are spaced from each other in the Z direction. The outer wall 68A is disposed further to the −Z side than the inner wall 68B. The above-described first lever 66 is disposed between the outer wall 68A and the inner wall 68B.

The outer wall 68A has a U shape that opens on the X side when seen in the Z direction. A shaft 68D is formed on an end portion of the outer wall 68A on the Y side on the X side of the outer wall 68A. The axis of the shaft 68D extends in the Z direction, and the shaft 68D projects to the −Z side. A cam follower 72 having a cylindrical shape when seen in the Z direction is provided on the shaft 68D so as to be rotatable about the shaft 68D. The cam follower 72 is included in the pressure member 48.

Furthermore, one end portion of a shaft 74 the axis of which extends in the Z direction is attached to a portion of the outer wall 68A substantially at the center in the Y direction on the −X side of the outer wall 68A. Another end portion of a shaft 74 is attached to a portion of the inner wall 68B substantially at the center in the Y direction on the −X side of the inner wall 68B. A cam follower 75 (see FIG. 2) having a cylindrical shape when seen in the Z direction is provided on the shaft 74 so as to be rotatable about the shaft 74. Furthermore, an end portion of the outer wall 68A on the −Y side on the X side of the outer wall 68A has a through hole 68E penetrating through the outer wall 68A in the Z direction. The shaft 38 is inserted into the through hole 68E.

The inner wall 68B has an L shape when seen in the Z direction. Furthermore, as has been described, the other end portion of the shaft 74 in the Z direction is attached to the portion of the inner wall 68B substantially at the center in the Y direction on the −X side of the inner wall 68B. Furthermore, an end portion of the inner wall 68B on the −Y side on the X side of the inner wall 68B has a through hole (not illustrated) penetrating through the inner wall 68B in the Z direction. The shaft 38 is inserted into this through hole. That is the end portion of the outer wall 68A on the −Y side and the end portion of the inner wall 68B on the −Y side are connected to the shaft 38 so as to allow the shaft 38 to be rotated about the axis C2. In other words, the second lever 68 is provided on the shaft 38 so as to be movable about the axis C2 in an arc-shaped path on the Z side and on the −Z side of the first lever 66.

The rear wall 68C connects an end portion of the outer wall 68A on the Y side on the −X side of the outer wall 68A to an end portion of the inner wall 68B on the Y side on the −X side of the inner wall 68B. Furthermore, the rear wall 68C has a through hole (not illustrated) that penetrates through the rear wall 68C in the X direction. An adjustment screw 76 is inserted through this through hole so as to be directed to the X side.

The adjustment screw 76 is inserted through the compression coil spring 67 between the rear wall 68C and the pressed portion 66E. Furthermore, the adjustment screw 76 has an external screw portion (not illustrated) at its end. This external screw portion is screwed into the internal screw portion of the pressed portion 66E of the first lever 66. Thus, when the adjustment screw 76 is screwed more into the pressed portion 66E, the compression coil spring 67 is compressed so as to increase the pushing force acting on the first lever 66.

Here, when the bracket 42 and the pressure member 48 are seen in the Z direction as illustrated in FIG. 2, moving the pressure member 48 clockwise about the axis C2 moves the bracket 42 counterclockwise about the axis C1. In contrast, moving the pressure member 48 counterclockwise about the axis C2 moves the bracket 42 clockwise about the axis C1.

The Cam Unit

The cam unit 80 of FIG. 2 includes a shaft 81, which is rotated by a motor (not illustrated), and a cam 82, which is attached to the shaft 81. The shaft 81 is disposed in the housing 31 with the axis of the shaft 81 extending in the Z direction. Both end portions of the shaft 81 in the Z direction are rotatably supported by the pair of side walls 33 and bearings (not illustrated). Furthermore, the shaft 81 is disposed further to the −X side than the second lever 68 so that the cam 82 and the cam follower 75 are in contact with each other.

When seen in the Z direction, the cam 82 has an elliptical shape having a long diameter portion (portion around the major axis) and a short diameter portion (portion around the minor axis) with a recess 82A formed in the short diameter portion. A portion between the long diameter portion and the short diameter portion is referred to as a middle diameter portion. Here, when the cam 82 is rotated, this causes, through the cam follower 75, the first lever 66 (see FIG. 3) and the second lever 68 to move about the axis C2 of the shaft 38 in arc-shaped paths. This causes the pressure pad 62 to press the pressure belt 34. That is, the pressure belt 34 is pressed toward the fixing roller 32 by using the pressure member 48 and the cam unit 80.

Figure 9A:
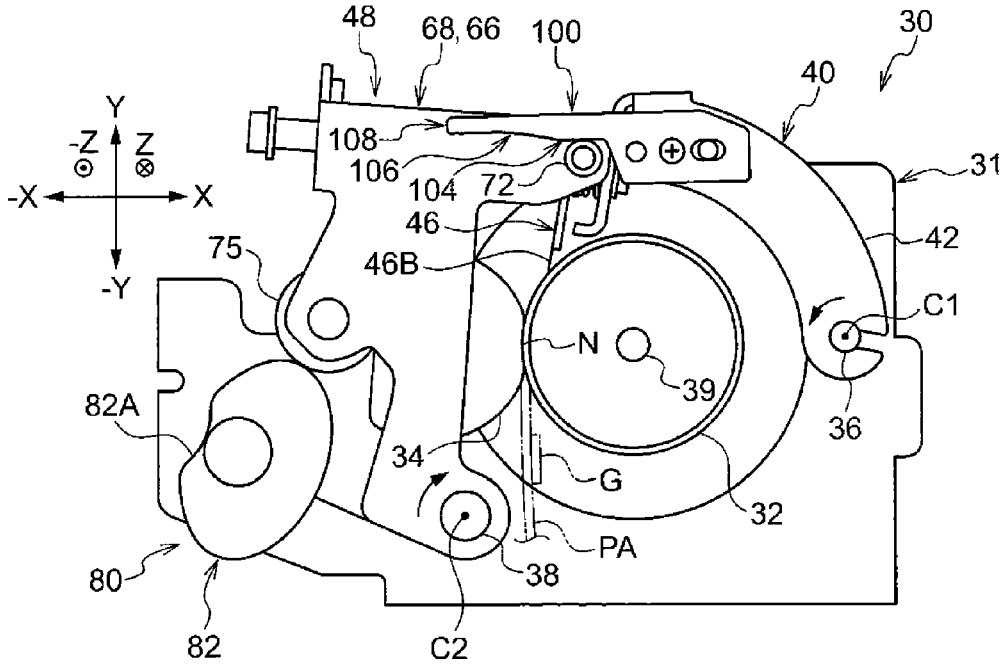
FIG. 9A illustrates disposition of the cam member and the second lever when the pressing state of the nip in the fixing section according to the present exemplary embodiment is in the full-latch state.

When the long diameter portion of the cam 82 is in contact with the cam follower 75, the fixing roller 32 and the pressure belt 34 are in the above-described full-latch state (see FIG. 9A). When the middle diameter portion of the cam 82 is in contact with the cam follower 75, the fixing roller 32 and the pressure belt 34 are in the above-described half-latch state (see FIG. 9B). Furthermore, when the recess 82A of the cam 82 is in contact with the cam follower 75, the fixing roller 32 and the pressure belt 34 are in the above-described latch release state (see FIG. 8). Switching between the latch release state, the half-latch state, and the full-latch state is performed by operating the cam unit 80 under control of the controller 22 (see FIG. 1) in accordance with the type of the sheet P.

When the sheet P is cardboard PB (see FIG. 9B) that is thicker than plain paper PA (see FIG. 9A), drive of the cam 82 is controlled so that the half-latch state is entered. When the sheet P is plain paper PA or thin paper that is thinner than the plain paper, the drive of the cam 82 is controlled so that the full-latch state is entered. Furthermore, when the sheet P is an envelope PC (see FIG. 8) or the like that is thicker than the cardboard PB, the drive of the cam 82 is controlled so that the latch release state is entered. In other words, the pressure member 48 is moved in accordance with the type of the sheet P. In the following description, the position of the pressure member 48 where the pressure member 48 having been moved enters the half-latch state is referred to as a movement position of the pressure member 48.

The Cam Member

Figure 4:
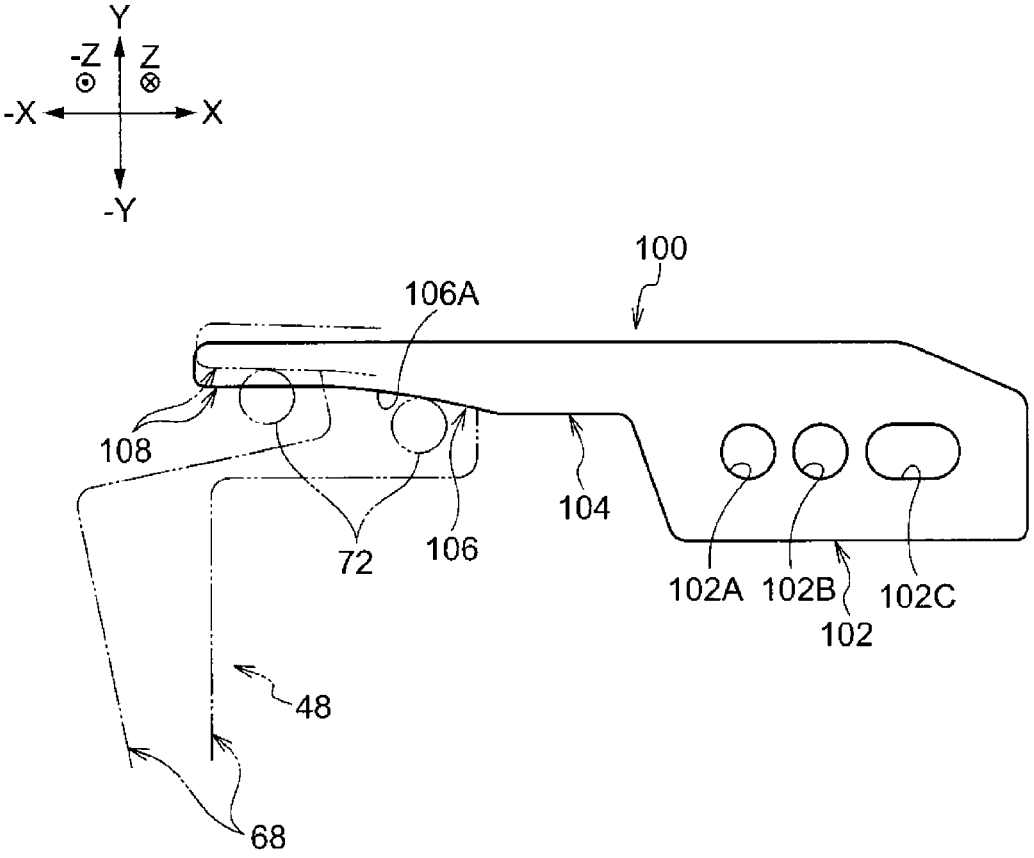
FIG. 4 illustrates a cam member according to the present exemplary embodiment.

As illustrated in FIG. 2, the cam member 100 is provided in the bracket 42. The cam member 100 is brought into contact with the pressure member 48 (cam follower 72) so as to transmit the movement of the pressure member 48 to the separation member 40. Furthermore, as illustrated in FIG. 4, the cam member 100 includes, for example, a body portion 102, a leg portion 104, a guide portion 106, and a release portion 108, which are integrated with one another.

The body portion 102 has a rectangular plate shape. The longitudinal direction of the body portion 102 is in the X direction and the transverse direction of the body portion 102 is in the Y direction. Furthermore, the body portion 102 has through holes 102A, 102B, and 102C which are spaced from one another in the X direction and penetrate through the body portion 102 in the Z direction. The through holes 102A and 102C have such sizes that the cam member 100 is able to be positioned by inserting the above-described bosses 53 (see FIG. 2) through the through holes 102A and 102C. The through hole 102B has such a size that the above-described screw 55 is able to be inserted through the through hole 102B. The body portion 102 is disposed in (secured to) the bracket 42 by inserting the screw 55 through the through hole 102B and screwing the screw 55 into the internal screw portion of the bracket 42 (see FIG. 2) with two bosses 53 inserted through the through holes 102A and 102C and positioned.

The leg portion 104 extends from an end portion on the Y side of an end portion of the body portion 102 on the −X side to the −X side. Furthermore, a surface of the leg portion 104 brought into contact with the cam follower 72 linearly extends in the X direction when seen in the Z direction. Here, when an outer circumferential surface of the cam follower 72 and the leg portion 104 are in contact with each other, the distance between an end surface of the leg portion 104 on the −Y side and the axis C2 (see FIG. 5) is larger than a distance L1 (see FIG. 5) between a contact surface 106A, which will be described later, and the axis C2. That is, when the cam follower 72 is in contact with the leg portion 104, the position of the cam member 100 is moved down further to the −Y side than when the cam follower 72 is in contact with the contact surface 106A, which will be described later.

The guide portion 106 extends in the X direction further to the −X side than the leg portion 104. Furthermore, the contact surface 106A to be in contact with the outer circumferential surface of the above-described cam follower 72 is formed on an end portion of the guide portion 106 on the −Y side. The contact surface 106A has an arc shape that is concave to the Y side when seen in the Z direction. Specifically, the contact surface 106A has an arc shape centered at the center position of the shaft 38 (see FIG. 2) when seen in the Z direction. The contact surface 106A is positioned on the opposite side to the shaft 38 side of the first lever 66 and the second lever 68 (see FIG. 2). Furthermore, when the pressure member 48 has been moved to the above-described movement position, the contact surface 106A is disposed so as to be in contact with the outer circumferential surface of the cam follower 72 from the Y side.

As illustrated in FIG. 5, when the contact surface 106A is seen in the Z direction, the radius of curvature of the contact surface 106A is, for example, equal to the distance L1 between the position where the cam follower 72 is in contact with the contact surface 106A and the center position of the shaft 38. In other words, the contact surface 106A is brought into contact with and guides the cam follower 72 so as to maintain the gap between the distal end portion 46B of the separation baffle 46 and the outer circumferential surface of the fixing roller 32. In addition, the contact surface 106A presses the pressure member 48 to the axis C1 side. That is, while the contact surface 106A is in contact with the cam follower 72, the gap between the distal end portion 46B of the separation baffle 46 and the outer circumferential surface of the fixing roller 32 is maintained. The length of the contact surface 106A in the X-Y plane is set corresponding to a moving range of the pressure member 48 (cam follower 72) including tolerance.

The release portion 108 extends in the X direction further to the −X side than the guide portion 106. The release portion 108 has a rectangular shape. The longitudinal direction of the release portion 108 is in the X direction and the transverse direction of the release portion 108 is in the Y direction when seen in the Z direction. Here, when the outer circumferential surface of the cam follower 72 and the contact surface 106A are in contact with each other, a distance L2 between an end surface of the release portion 108 on the −Y side and the axis C2 is smaller than the above-described distance L1. That is, when the cam follower 72 is brought into contact with the release portion 108 as a result of rotation of the pressure member 48, the cam member 100 (end portion of the bracket 42) is pressed upward to the Y side by a length corresponding to a distance (L1-L2).

A Comparative Example

Figure 10:
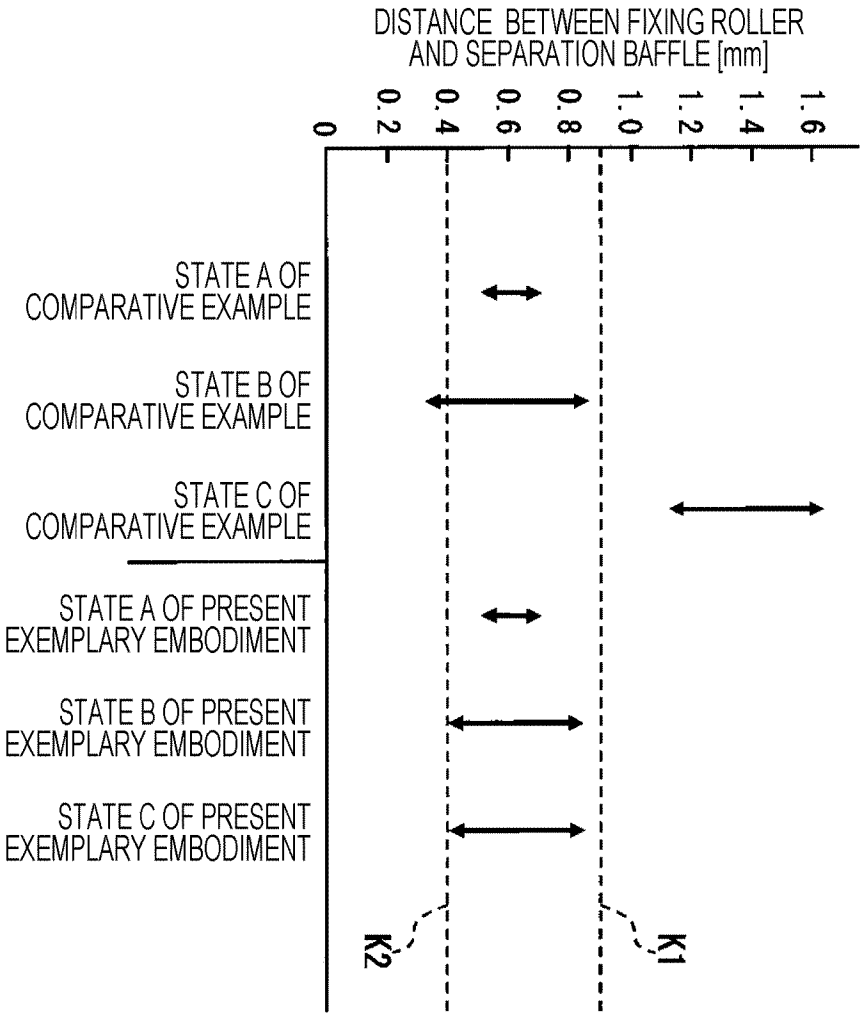
FIG. 10 is a graph for comparison of ranges of variation in gap between the fixing roller and the separation baffle, the gap being formed in the fixing section according to the present exemplary embodiment and in a fixing section according to a comparative example.

A fixing section of a comparative example (not illustrated) is prepared as follows: in the fixing section 30 of FIG. 2, the contact surface 106A (see FIG. 4) of the guide portion 106 is made to be flat in the X direction and continued with the release portion 108 when seen in the Z direction. The gap between the fixing roller 32 and the distal end portion 46B of the separation baffle 46 is measured by setting the full-latch state (state A of the comparative example), the half-latch state (state B of the comparative example), and the latch release state (state C of the comparative example) in the fixing section of the comparative example. Results of the measurement are illustrated in FIG. 10. The gap (unit: mm) is measured as follows: thin plates having known thicknesses are inserted one plate after another between the distal end portion 46B of the separation baffle 46 and the fixing roller 32, and the thickness of one of the thin plates having a maximum thickness among thin plates that are able to be inserted is regarded as a measured value. The measurement is performed, for example, five times.

A broken line K1 of FIG. 10 indicates an upper limit K1 of the gap between the fixing roller 32 and the separation baffle 46 when the sheet P is separated by the separation baffle 46 without a problem. A broken line K2 of FIG. 10 indicates a condition (lower limit) K2 that suppresses contact between the outer circumferential surface of the fixing roller 32 and the separation baffle 46. Furthermore, in FIG. 10, ranges of data of the gap between the fixing roller 32 and the separation baffle 46 including variation from the central values of the obtained data are represented by arrows. Here, gap data of the state A of the comparative example falls within a range between the upper limit K1 and the lower limit K2. However, some pieces of gap data of the state B of the comparative example are lower than the lower limit K2, and gap data of the state C of the comparative example largely exceeds the upper limit K1. That is, it is found that variation in gap between the fixing roller 32 and the separation baffle 46 is increased in the fixing section of the comparative example.

Operations

Next, operations of the present exemplary embodiment are described.

As illustrated in FIG. 8, in order to fix the toner image G onto the envelope PC by the fixing section 30, before a fixing operation is started, the cam unit 80 is driven by the controller 22 (see FIG. 1) so that the recess 82A of the cam 82 and the cam follower 75 are brought into contact with each other. Here, it is assumed in the following description that the pressing state before the start of the drive of the cam unit 80 is the half-latch state. At this time, the outer circumferential surface of the cam follower 72 and the release portion 108 are brought into contact with each other so as to press the release portion 108 upward to the Y side, thereby the bracket 42 is moved clockwise in FIG. 8 about the axis C1 in an arc-shaped path. This causes the distal end portion 46B of the separation baffle 46 to be separated from the outer circumferential surface of the fixing roller 32 and the fixing section 30 to enter the latch release state. In this state, the toner image G is fixed onto the envelope PC.

As illustrated in FIG. 9A, in order to fix the toner image G onto the plain paper PA or the thin paper by the fixing section 30, before the fixing operation is started, the cam unit 80 is driven by the controller 22 (see FIG. 1) so that the long diameter portion of the cam 82 and the cam follower 75 are brought into contact with each other. Accordingly, the position of the first lever 66 is moved further to the X side than that of the first lever 66 in the latch release state. The outer circumferential surface of the cam follower 72 and the leg portion 104 are brought into contact with each other, thereby the bracket 42 is moved counterclockwise in FIG. 9A in an arc-shaped path. This causes the distal end portion 46B of the separation baffle 46 to be brought into contact with the outer circumferential surface of the fixing roller 32 and the fixing section 30 to enter the full-latch state. In this state, the toner image G is fixed onto the plain paper PA or the thin paper.

Figure 9B:
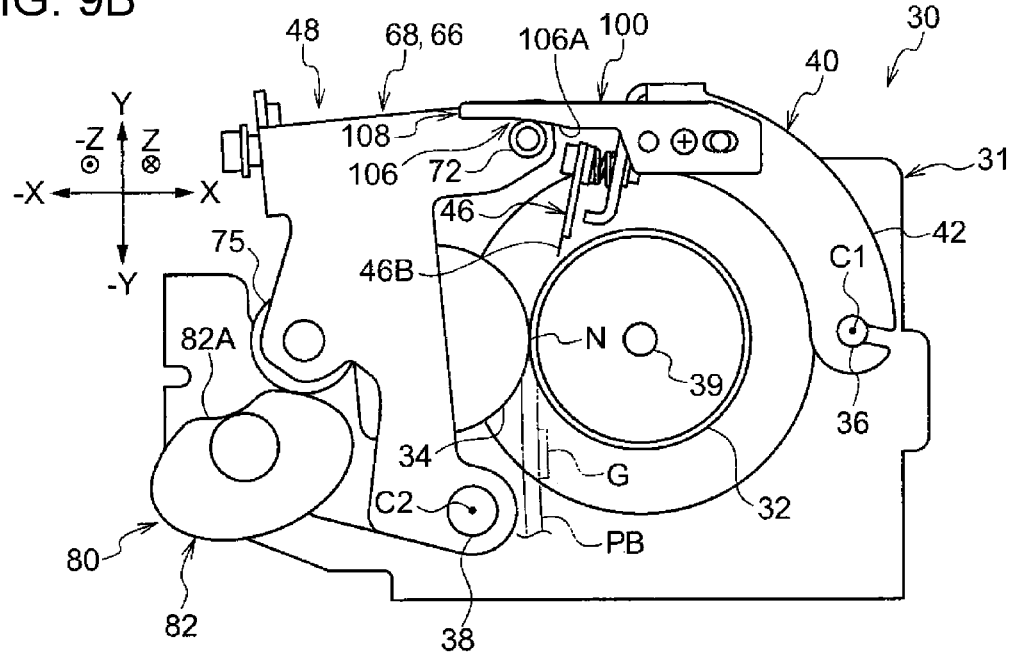
FIG. 9B illustrates disposition of the cam member and the second lever when the pressing state of the nip in the fixing section according to the present exemplary embodiment is in the half-latch state.

As illustrated in FIG. 9B, in order to fix the toner image G onto the cardboard PB by the fixing section 30, before the fixing operation is started, the cam unit 80 is driven by the controller 22 (see FIG. 1) so that the middle diameter portion of the cam 82 and the cam follower 75 are brought into contact with each other. Accordingly, the first lever 66 comes to a position that is further to the X side than the position of the first lever 66 in the latch release state and further to the −X side than the position of the first lever 66 in the full-latch state. The outer circumferential surface of the cam follower 72 and the contact surface 106A of the guide portion 106 are brought into contact with each other, thereby the position of the bracket 42 is moved further clockwise in FIG. 9A than that of the bracket 42 in the full-latch state. This causes the distal end portion 46B of the separation baffle 46 to be separated from the outer circumferential surface of the fixing roller 32 and the fixing section 30 to enter the half-latch state. In this state, the toner image G is fixed onto the cardboard PB.

An operation of the guide portion 106 performed when the pressing force of the pressure belt 34 applied to the fixing roller 32 is changed (the full-latch state is changed to the half-latch state) in the fixing section 30 is described in more detail.

As illustrated in FIG. 9B, in the fixing section 30, when the pressing state is changed from the full-latch state or the latch release state to the half-latch state, the cam follower 72 is brought into contact with the contact surface 106A of the cam member 100. At this time, the cam follower 72 is pressed in the radial direction of the shaft 38 from the Y side by the cam member 100 on which a force to move the cam member 100 to the −Y side about the axis C1 acts due to the weight of the cam member 100. Thus, the first lever 66 and the second lever 68 are moved about the axis C2 in an arc-shaped path with play in the radial direction (variation in stationary position in the radial direction) of the shaft 38 suppressed.

Furthermore, in the fixing section 30, the radius of curvature of the contact surface 106A of the guide portion 106 is equal to the distance L1 (see FIG. 5) between the position where the cam follower 72 is in contact with the contact surface 106A and the center position of the shaft 38. Thus, even when the pressure member 48 is moved to a position shifted forward or rearward in a movement direction from the movement position, the distance between the center position (axis C2) of the shaft 38 and the contact surface 106A is almost unchanged. In other words, while the contact surface 106A and the cam follower 72 are in contact with each other, a force to move (displace) the bracket 42 about the axis C1 is unlikely to act on the bracket 42. That is, since the displacement of the bracket 42 is suppressed, the gap between the distal end portion 46B of the separation baffle 46 and the outer circumferential surface of the fixing roller 32 is maintained. Thus, in the fixing section 30, variation in gap between the fixing roller 32 and the separation baffle 46 is suppressed when the pressing state of the pressure belt 34 with respect to the fixing roller 32 is changed in accordance with the type of the sheet P (for example, plain paper PA, cardboard PB, or envelope PC).

Furthermore, in the fixing section 30, since the variation in gap between the fixing roller 32 and the separation baffle 46 is suppressed, a contact state between the separation baffle 46 and a leading end portion of the sheet P having advanced from the nip N is unlikely to change. This may suppress wrapping of the sheet P around the fixing roller 32 compared to a structure having a flat contact surface 106A.

In the image forming apparatus 10 of FIG. 1, wrapping of the sheet P around the fixing roller 32 is suppressed in the fixing section 30. Thus, compared to a structure without the fixing section 30, chances of an operation in which the image forming apparatus 10 is stopped so as to remove the sheet P are reduced. This may suppress degradation of productivity.

Here, FIG. 10 illustrates the results of the measurement of the gap between the fixing roller 32 and the separation baffle 46 performed with the fixing section 30 (see FIG. 2) according to the present exemplary embodiment. A state A, a state B, and a state C of the present exemplary embodiment respectively represent the full-latch state, the half-latch state, and the latch release state. The gap is measured five times with the measuring method that is the same as or similar to that with which the measurement with the comparative example is performed. Referring to FIG. 10, ranges of data of the gap between the fixing roller 32 and the separation baffle 46 including variation from the central values of the obtained data are represented by arrows. As a result of the measurement, it is confirmed that the gap data of all of the state A, the state B, and the state C of the present exemplary embodiment falls within the range between the upper limit K1 and the lower limit K2. That is, it is confirmed that, according to the present exemplary embodiment, the variation in gap between the fixing roller 32 and the separation baffle 46 is suppressed compared to the comparative example.

Embodiments of the present invention are not limited to the above-described embodiment.

The recording medium transport device is not limited to the fixing section 30. For example, the recording medium transport device may be a transfer device that nips the sheet P between an intermediate transfer belt and a transfer roller so as to transport the sheet P and transfer the toner image G onto the sheet P. Alternatively, the recording medium transport device may be a sheet transport device that includes a transport belt, a pad provided on the inner circumferential side of the transport belt, and a transport roller that, together with the transport belt, nips the sheet P so as to transport the sheet P.

In the fixing section 30, even when the radius of curvature of the contact surface 106A of the guide portion 106 is slightly different from the distance between the position of the cam follower 72 in contact with the contact surface 106A and the center position of the shaft 38, the variation in gap between the fixing roller 32 and the separation baffle 46 is suppressed. Furthermore, the pressure pad 62 of the fixing section 30 does not necessarily include two types of pad members, that is, the pad members 62A and 62B. The pressure pad 62 may include a single pad member.

The transmission part may be formed in the bracket 42. That is, the cam member 100 and the bracket 42 may be integrated with each other. Contact surfaces of the guide portion 106 and the release portion 108 to be brought into contact with the cam follower 72 are not necessarily continuous with each other. There may be a step formed between these contact surfaces.

Instead of the cam follower 72, a pin may be provided in the first lever 66 so as to be brought into contact with the contact surface 106A.

The second lever 68 may support the holder 64 and the first lever 66 may be omitted in the pressure member 48.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording medium transport device comprising:

a first rotating member;

a second rotating member that is configured to form, together with the first rotating member, a nip which nips a recording medium in the nip so as to transport the recording medium;

a first shaft that extends in an axial direction of the first rotating member;

a second shaft that has a center position and that extends in an axial direction of the second rotating member;

a contact member that is disposed at a position downstream of the nip in a transport direction of the recording medium so as to be spaced from the first rotating member and so as to be, at the position where the contact member is disposed, brought into contact with the recording medium being transported and that is movable about an axis of the first shaft in an arc-shaped path at a region radially outside the first rotating member;

a pressure member that is movable about an axis of the second shaft in an arc-shaped path and that is configured to press the second rotating member toward the first rotating member; and a transmission part that is provided in the contact member or formed in the contact member, that is configured to be brought into contact with the pressure member so as to transmit a movement of the pressure member to the contact member, that has a surface configured to be in contact with the pressure member at a position on an opposite side to a second shaft side of the pressure member, and that has an arc shape centered at the center position of the second shaft.

2. A fixing device comprising:

the recording medium transport device according to claim 1; and a heat source, wherein the first rotating member includes an outer circumferential surface, wherein the contact member is configured to serve as a separation member that separates the recording medium from the outer circumferential surface of the first rotating member, and wherein the first rotating member is configured to serve as a fixing rotating member that is heated by the heat source and that fixes developer on the recording medium to the recording medium.

3. An image forming apparatus comprising:

a developer image forming device configured to form a developer image on a recording medium; and the fixing device according to claim 2 that is configured to fix to the recording medium the developer image formed on the recording medium by the developer image forming device.

4. The recording medium transport device according to claim 1, wherein the pressure member is movable according to a type of the recording medium.

5. The recording medium transport device according to claim 1, wherein the pressure member is movable to a full-latch state in which the contact member is in contact with the first rotating member and in which the first rotating member is in contact with the second rotating member, wherein the pressure member is movable to a half-latch state in which the contact member is not in contact with the first rotating member and in which the first rotating member is in contact with the second rotating member, and wherein the pressure member is movable to a latch release state in which the contact member is not in contact with the first rotating member and in which the first rotating member is not in contact with the second rotating member.

6. The recording medium transport device according to claim 5, wherein the recording medium transport device is configured such that switching between the latch release state, the half-latch state, and the full-latch state is performed by the operation of a cam unit and a cam follower, the cam follower being provided on the pressure member.

7. The recording medium transport device according to claim 6, wherein the cam unit is configured to, in response to a type of the recording medium being a plain paper type or a thin paper type, cause the pressure member to be in the full-latch state, wherein the cam unit is configured to, in response to the type of the recording medium being a cardboard type, cause the pressure member to be in the half-latch state, and wherein the cam unit is configured to, in response to the type of the recording medium being an envelope type, cause the pressure member to be in the latch release state.

* * * * *